US005558331A

United States Patent [19]

Zlotsky

[11] Patent Number: 5,558,331

[45] Date of Patent: Sep. 24, 1996

[54] STACKING PUZZLE

[76] Inventor: Dmitry Zlotsky, 59 W. Cedar St., Livingston, N.J. 07039

[21] Appl. No.: 420,285

[22] Filed: Apr. 10, 1995

[51] Int. Cl.[6] ..... A63F 9/12

[52] U.S. Cl. ..... 273/156; 273/157 R

[58] Field of Search ..... 273/153 R, 155, 273/156, 157 R, 153 S, 157 A; 446/69, 117, 118, 122

[56] References Cited

U.S. PATENT DOCUMENTS

| | | | |
|---|---|---|---|
| 423,066 | 3/1890 | Massey | 446/117 |
| 3,375,009 | 3/1968 | Stubbmann et al. | 273/156 |
| 3,630,527 | 12/1971 | Breslow | 273/157 R |
| 4,040,630 | 8/1977 | Brattain | 273/157 R |
| 4,437,668 | 3/1984 | Simpson et al. | 273/156 |
| 4,509,920 | 4/1985 | Kaufmann | 273/157 R |
| 4,518,165 | 5/1985 | Shmueli | 273/156 |
| 5,145,177 | 9/1992 | Wells | 273/156 |

FOREIGN PATENT DOCUMENTS

| | | | |
|---|---|---|---|
| 596861 | 3/1978 | Switzerland | 273/156 |

*Primary Examiner*—Steven B. Wong

[57] ABSTRACT

A logical puzzle including a plurality of elements stackable atop one another. Each element comprises pegs of varied lengths and apertures dimensioned to receive pegs therethrough. When all elements are properly stacked and oriented relative to one another, the apertures form passages permitting the reception of pegs, thus forming a substantially solid structure. By lifting elements and placing them in a random order a state of disorder is produced. The objective now is to restore the original state of order by stacking elements atop one another and by their suitable relative orientation in order to form a substantially solid structure. Although there are a multitude of incorrect ways to arrange puzzle elements only one correct arrangement allows them to form a substantially solid structure.

18 Claims, 6 Drawing Sheets

STACKING PUZZLE

BACKGROUND OF THE INVENTION

This invention relates generally to puzzles, and, more particularly, to three dimensional stacking puzzles. It is known to provide puzzle toys wherein a plurality of elements are stackable atop one another. It is important for a successful puzzle not only to challenge a player with a logical or manipulative task but to present an attractive tangible design and an attractive and clear idea behind a particular implementation of the puzzle. Both the challenge and the attraction of the puzzle increase when its elements are almost identical. Another important component of success is a design that allows a puzzle in a state of disorder not to fall apart into separate elements, but rather be held together.

SUMMARY OF THE INVENTION

The invention provides a puzzle comprising a base, a plurality of pegs of varied length projecting upwardly from said base, a plurality of inmost elements, hereinafter referred to as "game elements", and a top element, hereinafter referred to as "top", with a plurality of pegs of varied lengths projecting downwardly from said top. Each of the game elements includes a plurality of apertures dimensioned to receive said pegs projecting from said base and said top therethrough. Said game elements and said top are therefore stackable over said base atop one another. In an initial state of order, all game elements and the top are stacked over said base atop one another in a unique order and orientation of game elements and the top relative to the base and to one another so as to align apertures of said game elements and form passages, permitting said passages to receive said pegs therethrough, and, therefore, allow the puzzle to form a substantially solid structure of minimum height, equal to a sum of widths of said base, said game elements and said top. When the puzzle is to be used, the top and game elements are lifted off of the base. Game elements are then "mixed up" or otherwise placed in random order. The object of the puzzle is to place the game elements and the top onto the base in order to form a substantially solid structure.

The invention also provides a puzzle comprising a base, having a plurality of pegs of varied lengths projecting upwardly and a plurality of apertures. The puzzle further includes a plurality of game elements, each including a plurality of pegs of varied length projecting both upwardly and downwardly and a plurality of apertures dimensioned to receive said pegs therethrough. Said game elements have pegs and apertures oriented so that the game elements can form a substantially solid structure only when game elements are stacked over said base atop one another in a unique order, positioned in a unique orientation relative to one another and to the base, and, since apertures and pegs are not, in general, symmetrical, the game elements have to be placed with the correct side "up".

In one embodiment, the puzzle also includes a base having an upwardly extending, substantially vertical center post over and around which the game elements are placed.

In one embodiment, the puzzle also includes a base having an upwardly extending, substantially vertical center post over and around which the game elements are placed, and a means to prevent the game elements and the top to be taken off of the center post. In this embodiment game elements are "mixed up" by lifting them, freeing specific game element's pegs and apertures from adjacent element's apertures and pegs, and rotating said element around said center post. The center post has to be sufficiently high to permit free rotation of each individual game element.

In one embodiment, the base, game elements and the top are substantially circular in form.

In one embodiment, the base, game elements and the top are substantially hexagonal in form.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENTS

Figure 1:
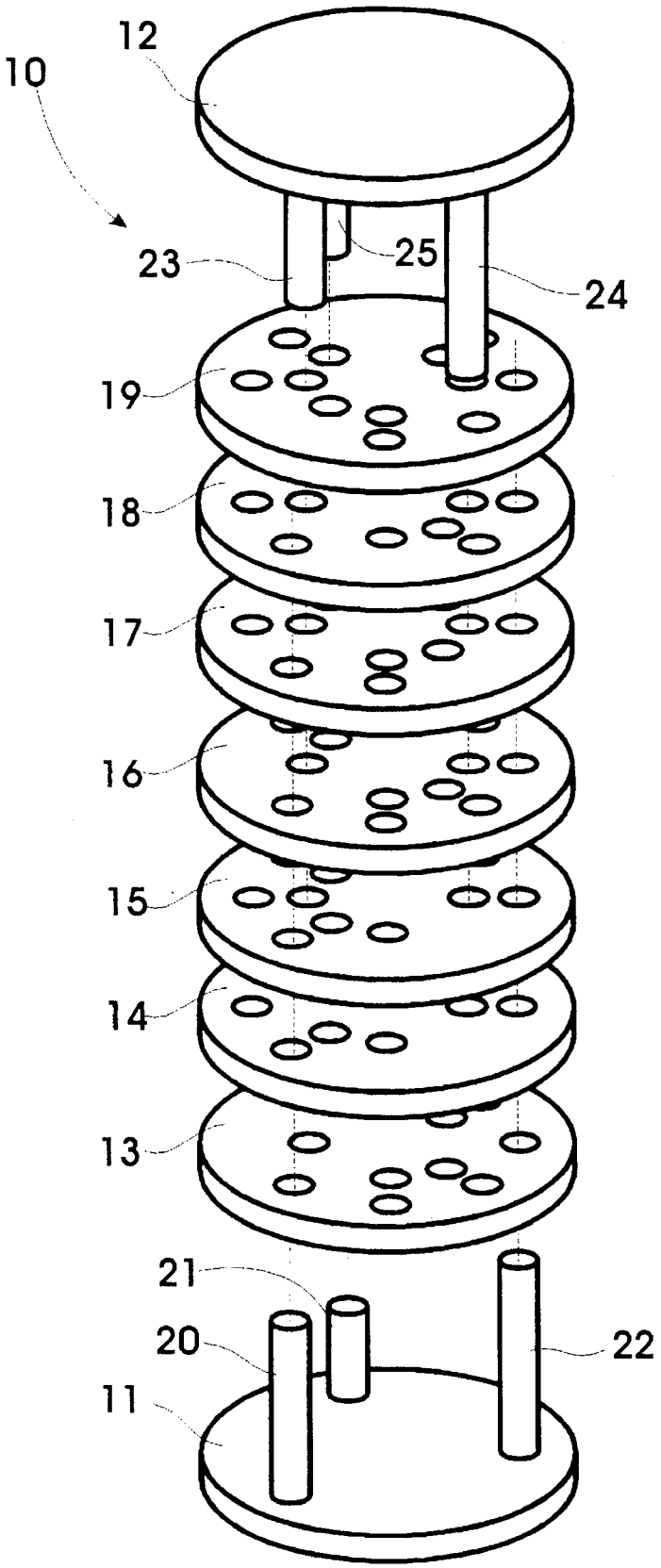
FIG. 1 is an exploded view of a puzzle constructed in accordance with various aspects of the invention.

Referring to the drawings, and, in particular to FIGS. 1, a logical puzzle 10 constructed in accordance with various aspects of the invention is illustrated. In the illustrated embodiment, the puzzle includes a base portion 11 having a plurality of elongate, substantially rigid rods or pegs 20–22 of varied lengths, substantially vertical and upwardly extending. The puzzle further includes a plurality of innermost game elements 13–19 and a top element 12, having a plurality of elongate, substantially rigid rods or pegs 23–25 of varied length, substantially vertical and downwardly extending. The base 11, game elements 13–19 and the top 12 in the illustrated embodiment, have the general form of circular disks.

As illustrated and in accordance with one aspect of the invention game elements 13–19 include a plurality of apertures dimensioned to receive pegs 20–25 therethrough. Said apertures in game elements 13–19 and pegs 20–25 are so located and oriented that, when game elements 13–19 and top element 12 are stacked atop one another as shown in FIG. 1 said apertures in the elements 13–19 align to form passages in which pegs 20–25 can be received to let puzzle 10 to form a substantially solid structure. In the illustrated embodiment the base 11 includes three upwardly extending pegs and top 12 includes three downwardly extending pegs.

Preferably said apertures and pegs are located, oriented and elongated (pegs only) so that a unique order and orientation of game elements and a top allows the puzzle to form a substantially solid structure. When the puzzle is to be used, top element 12 and game elements 13–19 are lifted off of the base 11. Top 12 and game elements 13–19 are then "mixed up" or otherwise placed in random order. The object of the puzzle is to reassemble the elements 12–19 onto the base 11 so as to align the apertures of elements 13–19 and permit reintroduction of pegs 20–25 into passages formed by said apertures, in order to form a substantially solid structure.

Although the materials used in construction of the puzzle are not critical, in the preferred embodiment the game elements 13–19, as well as base 11, and top 12, are all made of wood or molded from a rigid, thermoplastic material such as biturate plastic. Additionally, elements 11–19 as well as pegs 20–25 may be colored in bright, attractive colors. Although the specific number of game elements and the specific arrangement of pegs extending from the base and the top, including their number, length and location, and the specific arrangement of apertures in game elements, including their number and orientation, can be varied in order to change the relative difficulty of the puzzle, in the preferred embodiment seven game elements, three pegs extending upwardly from base 11 and three pegs extending downwardly from top 12 are provided.

Figure 2:
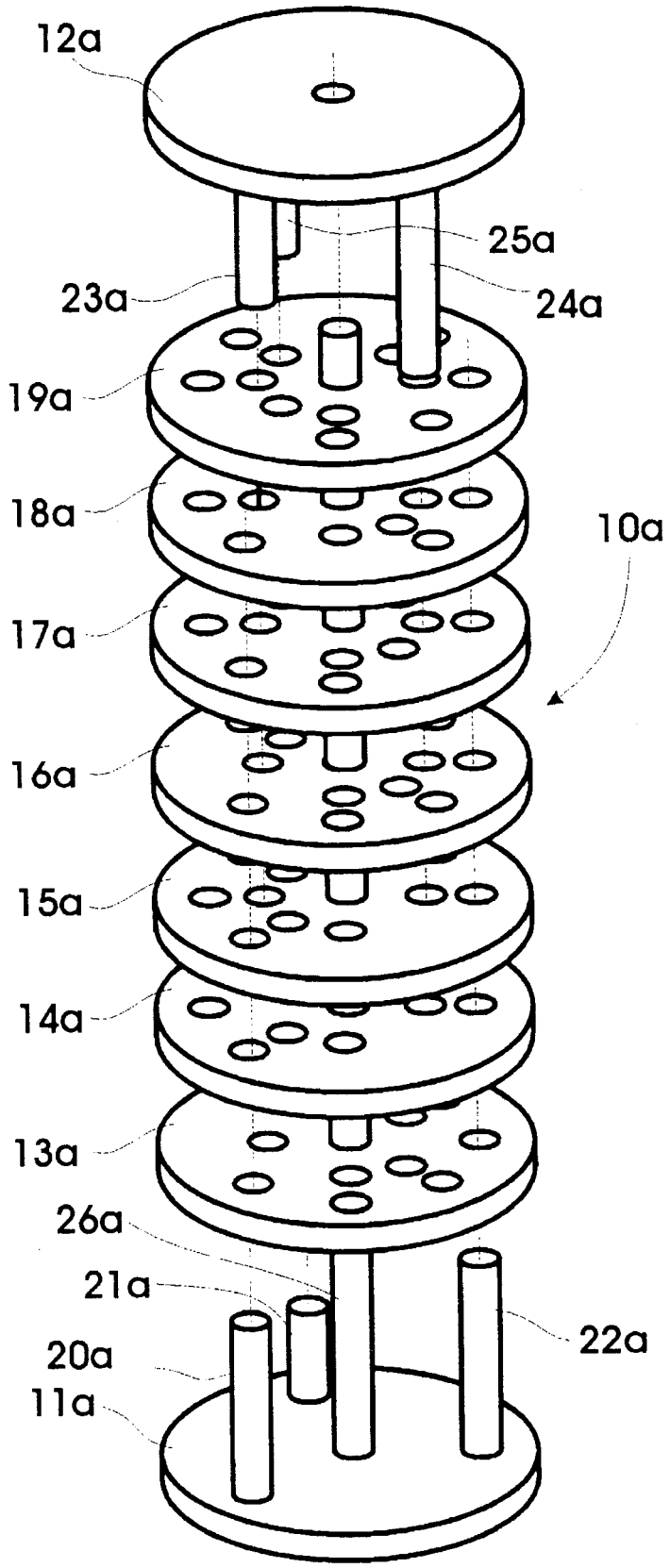
FIG.2 is an exploded view of another alternate embodiment of the puzzle constructed in accordance with various aspects of the invention.

An alternate embodiment of the puzzle 10a is illustrated in FIG. 2. In this embodiment, in addition to elements shown in FIG. 1, the puzzle comprises a center rod or post 26*a*, substantially vertical and extending upwardly from base 11*a*. In this embodiment, game elements 13*a*–19*a* and top 12*a* also include a center aperture dimensioned to receive said post therethrough.

Figure 3:
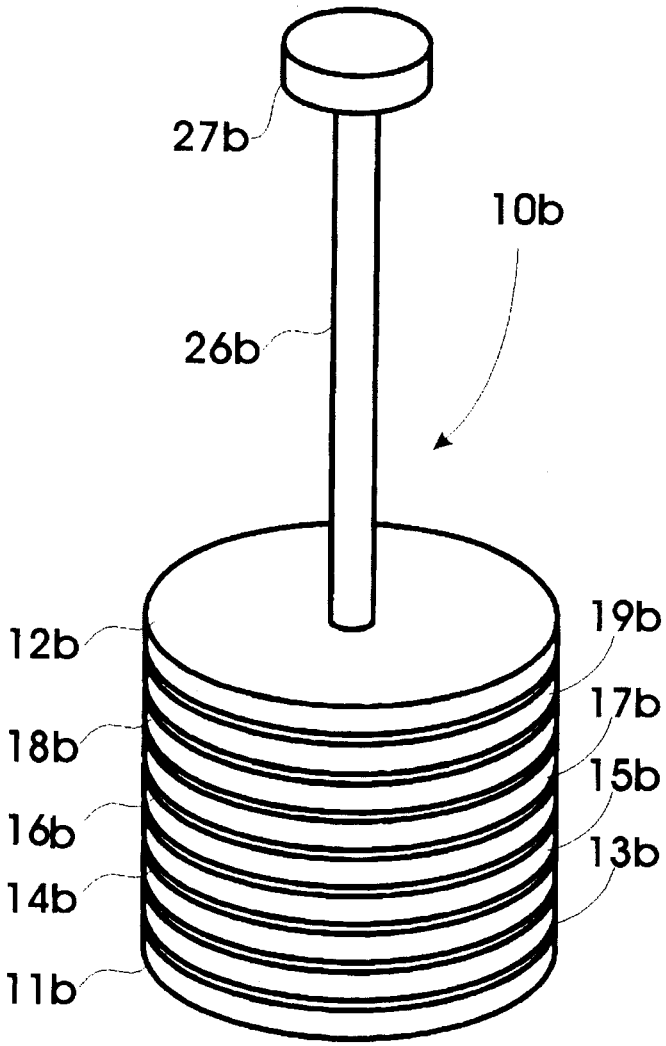
FIG. 3 is a perspective view of an alternate embodiment of the puzzle constructed in accordance with various aspects of the invention.

Still another alternate embodiment of the puzzle 10*b* is illustrated in FIG. 3. In this embodiment, in addition to elements shown in FIG. 2, the puzzle comprises a means to prevent game elements 13*b*–19*b* and top 12*b* to be taken off of the center post 26*b* in order to make the puzzle self-contained and therefore more attractive. In the preferred embodiment said means is implemented as stopper 27*b*-an element, connected to the top end of central post 26*b*. The center post 26*b* has to be high enough to permit each game element 13*b*–19*b* to rotate freely, or otherwise when no peg, extending from a base or a top is received by an aperture of a said game element, around the central post 26*b* when the top 12*b* is lifted to a maximum height, limited by the location of the stopper 27*b*. Even though FIG. 3 shows stopper 27*b* as having a circular disk-like form, the specific implementation of the stopper is irrelevant as long as it serves the purpose to prevent the puzzle to be taken apart. The center post 26*b* and the stopper 27*b* can be incorporated into any of the embodiments shown in FIGS. 1, 2, 4, 5, 6 and 7.

Figure 4:
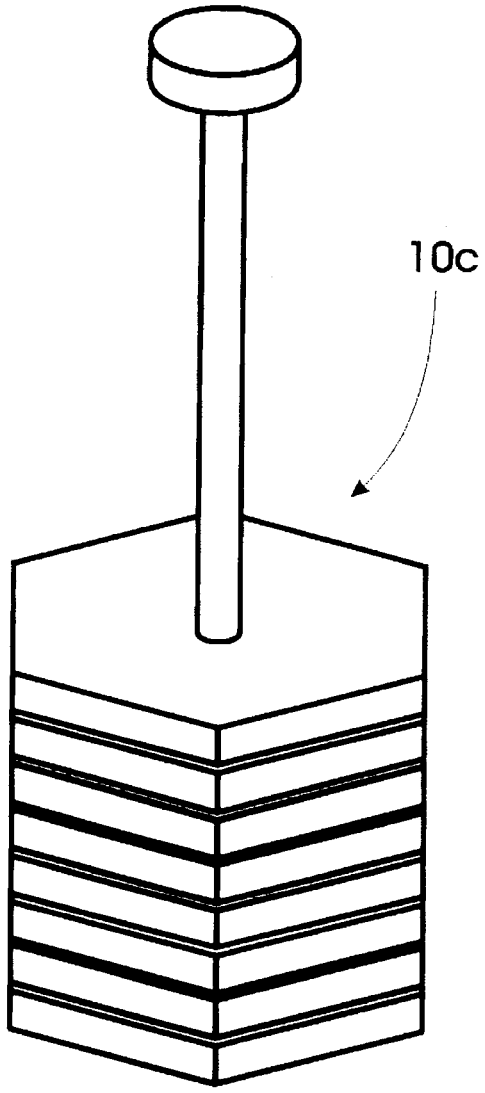
FIG. 4 is a perspective view of another alternate embodiment of the puzzle constructed in accordance with various aspects of the invention.

Still another embodiment of the puzzle 10*c* is shown in FIG. 4. In this embodiment, which is otherwise similar to the embodiment shown in FIG. 3, a base, elements and a top are of hexagonal form rather then the circular disk-like form shown in FIGS. 1–3.

Figure 5:
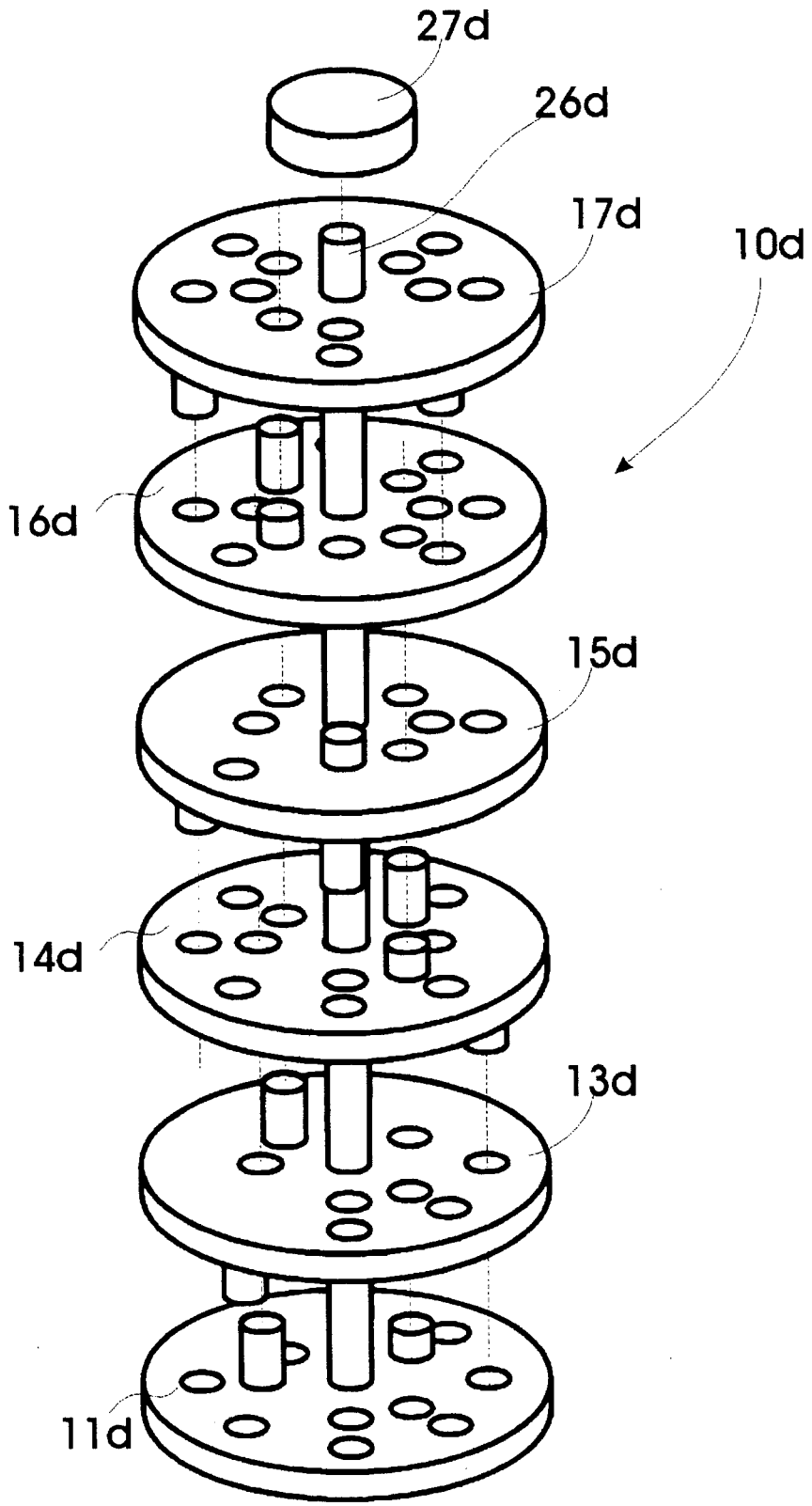
FIG. 5 is an exploded view of still another alternate embodiment of the puzzle constructed in accordance with various aspects of the invention.
Figure 6:
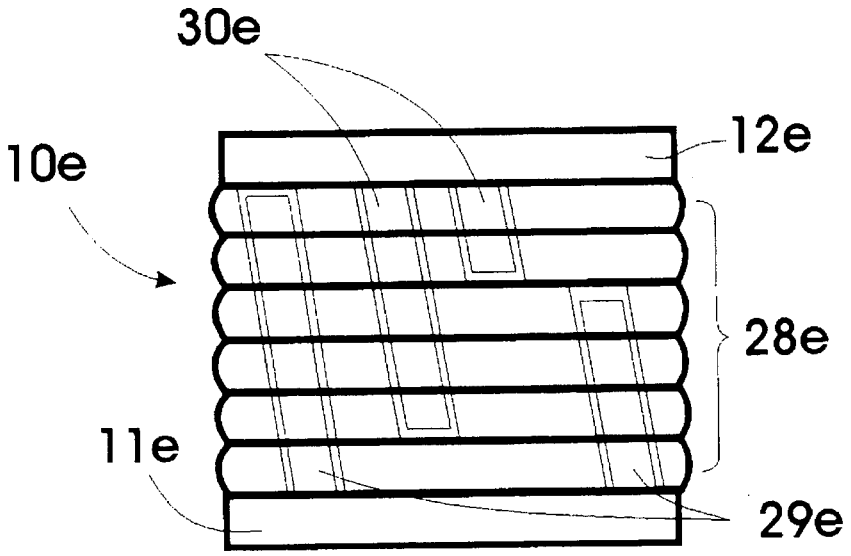
FIG. 6 is a side view of still another alternate embodiment of the puzzle constructed in accordance with various aspects of the invention.
Figure 7:
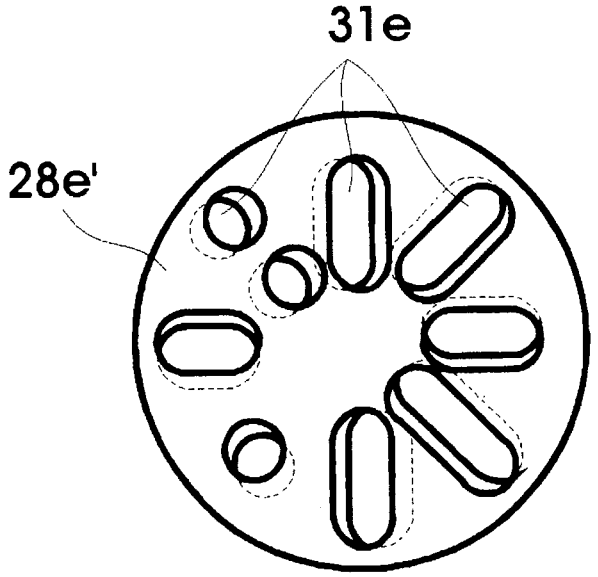
FIG. 7 is a top view of an element of the puzzle shown in FIG.6.

Still another embodiment of the puzzle 10*d* is shown in FIG. 5. In this embodiment, the base 11*d* includes an extending upwardly center post 26*d*, a plurality of substantially vertical pegs of varied length, extending upward, and a plurality of apertures. The puzzle further includes a plurality of game elements 13*d*–17*d*, each including a plurality of pegs of varied length, extending substantially vertical either upward or downward or both, and a plurality of apertures, dimensioned to receive said pegs therethrough. The object of this puzzle is the same as of one, shown in FIGS. 1–4, i.e. to disassemble the puzzle by lifting elements 13*d*–17*d* off of the central post 26*d*, placing them in random order and reassembling, using a unique stacking order and relative orientation to form a substantially solid structure. Still another embodiment of the puzzle 10*e* is shown in FIGS. 6–7. In this embodiment,, which is otherwise similar to the embodiment shown in FIG. 1, pegs 29*e* extending from base 11*e* and pegs 30*e* extending from top 12*e* are substantially oblique or non-vertical. Furthermore, the apertures of game elements 28*e* are also made oblique to form skewed or non-vertical passages to receive said pegs 29*e* and 30*e* therethrough when game elements 28*e* are properly stacked and oriented relative to one another. FIG. 7 illustrates a sample game element 28*e*', in which apertures 31*e* are made oblique and may be of substantially circular or peanut-like shape.

Figure 8:
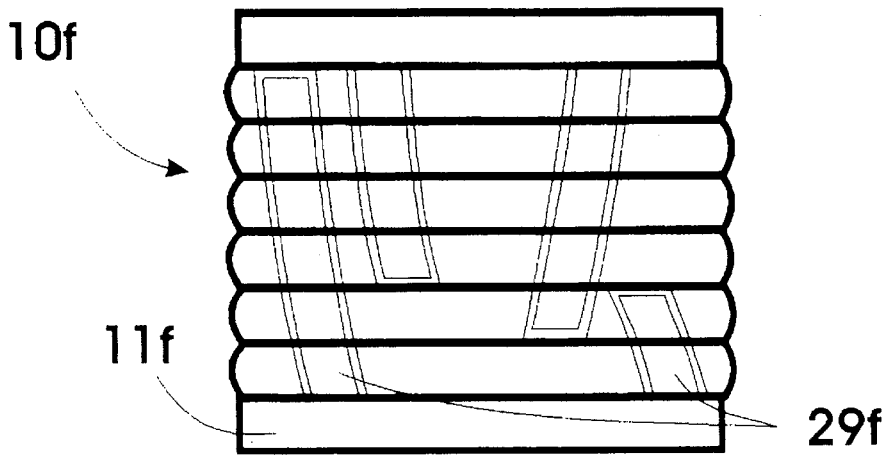
FIG. 8 is a side view of another alternate embodiment of the puzzle constructed in accordance with various aspect of the invention.
Figure 9:
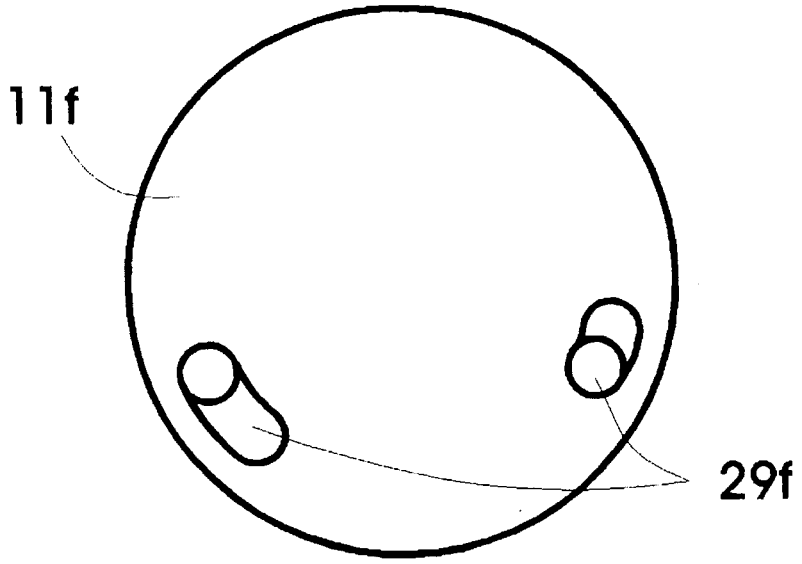
FIG. 9 is a top view of an element of the puzzle shown in FIG. 8.

Still another embodiment of the puzzle 10*f* is shown in FIGS. 8–9. In this embodiment, which is otherwise similar to the embodiment shown in FOGS. 6–7, pegs 29*f* extending from the base element 11*f* and pegs extending from the top element are substantially curved. FIG. 8 shows a side view of the puzzles 10*f*. FIG. 9 shows a top view of the base element 11*f*, with curved pegs 29*f* extending upward. As previously noted, the materials used in the construction of the puzzle are not critical provided they are reasonably durable and rigid enough to resist substantial deformation during use. Although circular and hexagonal forms of the base, innermost elements and the top have been shown and described, these shapes are not critical and the puzzle can be implemented using a base, innermost elements and a top having other (e.g. pentagonal) shapes or even different shapes for the base, for each of the innermost elements and for the top. Additionally, the precise number of innermost game elements and the specific arrangement of pegs extending from the base and the top (and from game elements for a puzzle shown in FIG. 5), including their number, length and location, and the specific arrangement of the apertures in innermost elements (and the base and the top for the puzzle shown in FIG. 5), including their number and orientation, can differ from those shown in FIGS. 1–7. Finally the puzzle need not be implemented in the form of actual, physically real objects but may, for example, be represented as a computer generated image on an appropriate display screen.

While a particular embodiment of the invention has been shown and described, it will be obvious to those skilled in the an that changes and modifications can be made without departing from the invention in its broader aspects, and, therefore, the aim in the appended claims is to cover all such changes and modifications as fall within the true spirit and scope of the invention.

I claim:

1. A puzzle comprising:

a base element having a plurality of pegs of varied lengths extending upwardly from said base element;

a top element, having a plurality of pegs of varied length extending downwardly from said top element;

a plurality of game elements, each of said game element having a plurality of apertures dimensioned to receive said pegs therethrough;

the object of said puzzle being to stack said game elements and said top element in a unique order atop said base element and to position said game elements in unique rotational positions so as to align said apertures and allow thereby the passage of said pegs therethrough in order to form a substantially solid structure.

2. A puzzle as defined in claim 1 wherein said puzzle further includes a substantially vertical center post, attached to and upwardly extending from said base element, and wherein each of said game elements and said top element include an additional center aperture permitting said game elements to be stacked atop said base element around said center post.

3. A puzzle as defined in claim 2 wherein said puzzle further includes a means for preventing the game elements and the top element from being taken off of the center post.

4. A puzzle as defined in claim 3 wherein each of said base element, said top and said game elements is of substantially circular disk-like form.

5. A puzzle as defined in claim 3 wherein each of said base element, said top and said game elements is of substantially hexagonal form.

6. A puzzle as defined in claim 3 wherein said pegs, extending from the base element and from the top element are substantially vertical and said apertures of said game elements are substantially perpendicular to the planar surfaces of said game elements.

7. A puzzle as defined in claim 3 wherein said pegs, extending from the base element and from the top element are substantially non-vertical and said apertures of said game elements are substantially non-perpendicular to the planar surfaces of said game elements.

8. A puzzle as defined in claim 7 wherein said pegs are substantially straight.

9. A puzzle as defined in claim 7 wherein said pegs are substantially curved.

10. A puzzle as defined in claim 6 wherein said apertures of said game elements are substantially circular.

11. A puzzle as defined in claim 7 wherein said apertures of said game elements are generally non-circular.

12. A puzzle comprising:

a base element having a plurality of pegs of varied lengths extending upwardly from said base element, and a plurality of apertures, dimensioned to receive said pegs therethrough;

a plurality of game elements, each of said game elements having a plurality of pegs of varied lengths, extending either upwardly or downwardly from said game elements;

each of said game elements further having a plurality of apertures dimensioned to receive said pegs therethough;

the object of said puzzle being to stack said game elements in a unique order atop said base element and to position said game elements in unique rotational positions so as to align said apertures and allow thereby the passage of said pegs therethrough to form a substantially solid structure.

13. A puzzle as defined in claim 12 wherein said puzzle further includes a substantially vertical center post, attached to and upwardly extending from said base element and wherein each of said game elements includes an additional center aperture permitting said game elements to be stacked atop said base element around said center post.

14. A puzzle as defined in claim 13 wherein said puzzle further includes a means for preventing the game elements from being taken off of the center post.

15. A puzzle as defined in claim 14 wherein said pegs, extending from the base element and from the game element as substantially vertical and said apertures of said game elements are substantially perpendicular to the planar surfaces of said game elements.

16. A puzzle as defined in claim 14 wherein said pegs, extending from the base element and from the game elements are substantially non-vertical and said apertures of said game elements are substantially non-perpendicular to the planar surfaces of said game elements.

17. A puzzle as defined in claim 16 wherein said pegs are substantially straight.

18. A puzzle as defined in claim 16 wherein said pegs are substantially curved.

* * * * *